US006866931B2

(12) United States Patent
Takeuchi et al.

(10) Patent No.: US 6,866,931 B2
(45) Date of Patent: Mar. 15, 2005

(54) ACRYLIC BASED COMPOSITE FIBER AND METHOD FOR PRODUCTION THEREOF, AND FIBER COMPOSITE USING THE SAME

(75) Inventors: Satoru Takeuchi, Hiroshima (JP); Masakazu Hoshino, Hiroshima (JP); Ryo Ochi, Hiroshima (JP); Yukio Kasabou, Osaka (JP); Eizou Sakurai, Aichi (JP); Masanori Akasaka, Osaka (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 10/482,416

(22) PCT Filed: Mar. 19, 2002

(86) PCT No.: PCT/JP02/02603

§ 371 (c)(1),
(2), (4) Date: Jan. 12, 2004

(87) PCT Pub. No.: WO03/008678

PCT Pub. Date: Jan. 30, 2003

(65) Prior Publication Data

US 2004/0175565 A1 Sep. 9, 2004

(30) Foreign Application Priority Data

Jul. 11, 2001 (JP) ..... 2001-210366
Mar. 14, 2002 (JP) ..... 2002-070368

(51) Int. Cl.[7] ..... D01F 8/00
(52) U.S. Cl. ..... 428/370; 428/373; 428/374; 428/398
(58) Field of Search ..... 428/370, 373, 428/374, 398

(56) References Cited

U.S. PATENT DOCUMENTS 4,346,146 A * 8/1982 Kondo et al. ..... 428/398
4,351,879 A * 9/1982 Kondo et al. ..... 428/374
4,460,648 A * 7/1984 Kondo et al. ..... 428/373

FOREIGN PATENT DOCUMENTS

GB 2108040 5/1973
JP 56-148916 11/1981

(List continued on next page.)

*Primary Examiner*—N. Edwards
(74) *Attorney, Agent, or Firm*—Oblon, Spivak, McClelland, Maier & Neustadt, P.C.

(57) ABSTRACT

An object of this invention is to provide an acrylonitrile based composite fiber having a new feeling different from that of an ordinary cellulose acetate fiber, cellulose fiber and acrylic fiber, excellent spinability, fiber properties and process ability of yarn spinning, and excellent functions, in particular, a deodorizing function and a moisture absorbing and retaining property.

The composite fiber is comprised of 10 to 40% by weight of cellulose acetate and/or cellulose and 60 to 90% by weight of an acrylonitrile based polymer, and has a structure with the cellulose acetate and/or cellulose forming an island component in a cross section perpendicular to a fiber axis and the acrylonitrile based polymer forming a sea component. Preferably, the cellulose acetate and/or cellulose as the island component communicate with another island component in the fiber axis direction, a vacant hole is provided inside the fiber, or a ratio of the longest diameter and the shortest diameter of the fiber cross section is 2 or less, and 5 or more recess parts of 0.3 μm or more and 3 μm or less width and 0.3 μm or more and 3 μm or less depth are provided in a fiber cross section outer circumferential part. Further preferably, by applying a heat treatment under alkali in a production stage, the moisture absorbing and retaining property can be improved.

18 Claims, 3 Drawing Sheets

EXAMPLE 1

FOREIGN PATENT DOCUMENTS

| | | | |
|---|---|---|---|
| JP | 1-259867 | | 10/1989 |
| JP | 2-080611 | | 3/1990 |
| JP | 2-99609 | | 4/1990 |
| JP | 2-154713 | | 6/1990 |
| JP | 3-234808 | | 10/1991 |
| JP | 9-176917 | | 7/1997 |
| JP | 9-291416 | | 11/1997 |
| JP | 10-8327 | | 1/1998 |
| JP | 11-279842 | | 10/1999 |
| JP | 2003089924 A | * | 3/2003 |

* cited by examiner

ACRYLIC BASED COMPOSITE FIBER AND METHOD FOR PRODUCTION THEREOF, AND FIBER COMPOSITE USING THE SAME

TECHNICAL FIELD

This invention relates to an acrylic based composite fiber comprising cellulose acetate and/or cellulose, and an acrylonitrile based polymer, a method for producing the same, and a fiber composite using the same and another fiber, such as a knitted woven fabric and a non-woven fabric.

BACKGROUND ART

An acrylic fiber having an excellent color developing property, bulkiness, heat retaining property and soft feeling is a material used widely in a clothes field, accessory field, interior field, material field or the like, and it is developed mainly by staple. In contrast, cellulose acetate having an excellent glossiness, color developing property and dry feeling is regarded as a high quality clothes material, and it is developed mainly by tow and filament. However, since it does not have a fiber physical property durable for yarn spinning, it is not developed by staple.

Recently, development of a new material having a new feeling and functions, such as one having a deodorizing function and a moisture absorbing and retaining function in particular, is highly demanded, and as a method for developing techniques, there is polymer compositing. Complexing of a polymer is an effective method for reciprocating material characteristics of each other. Several reports have been provided on the polymer compositing technique of cellulose acetate and an acrylonitrile based polymer. As to the feeling, for example, a technique for compositing cellulose acetate and an acrylonitrile based polymer is disclosed in Japanese Patent Application Laid-Open (JP-A) Nos. 2-154713, and 3-234808. JP-A No. 2-154713 is for one having a feeling inherent to a conventional acetate fiber, and JP-A No. 3-234808 is for one having a feeling inherent to a conventional dry acrylic based fiber.

As to the deodorizing function, for example, JP-A No. 1-259867 discloses a technique for orienting a metal ion to an amide oximated fiber. However, according to the technique, since the fiber is colored by a hue inherent to the metal, a ;problem is involved in that an end use is limited. Furthermore, a technique for adding a silicate metal salt or an aminomo silicate metal salt to an acrylic based copolymer (JP-A Nos. 9-176917 and 9-291416) has been proposed. Since the technique requires a copolymer having acrylonitrile as a principal constituent unit and a non compatible polymer having miscibility in addition to an additive, a production process is complicated. Additionally, although a technique for containing a titanium oxide having a photo catalyst function in a fiber (JP-A No. 10-8327) has been proposed, it does not function effectively at a place whereat ultraviolet rays are weak.

Moreover, as to the moisture absorbing function, which is often applied by a post-process, washing resistance is poor. Therefore, a binder such as acrylic resin, an urethane resin and an epoxy resin is needed for improving durability, which deteriorates the feeling of the fiber itself, and thus it is problematic. Furthermore, a technique for compositing a moisture absorbing and discharging component in a synthetic fiber has been proposed. Although the technique (JP-A No. 11-279842) has both a moisture absorbing function and a moisture discharging function, no description is disclosed for a moisture retaining function thereof.

In order to solve the above-mentioned conventional problems, an object of the invention is to provide an acrylic based composite fiber having a new feeling different from that of a conventional cellulose acetate fiber, cellulose fiber and acrylic fiber, excellent fiber physical properties and process ability of yarn spinning, and excellent function properties, in particular, a deodorizing function and moisture absorbing and retaining function.

DISCLOSURE OF THE INVENTION

As a result of elaborate discussions by inventors of this invention for solving the above-mentioned problems, the following invention has been attained. The object of the invention is an acrylic based composite fiber composed of 10 to 40% by weight of cellulose acetate and/or cellulose and 60 to 90% by weight of an acrylonitrile based polymer, characterized by comprising a structure with the cellulose acetate and/or cellulose forming an island component in a cross section perpendicular to a fiber axis (fiber lateral cross section), and the acrylonitrile based polymer forming an sea component, a method for producing the same, and a fiber composite using the above-mentioned composite fiber.

As mentioned above, as a method for developing a new material having a new feeling, compositing of a polymer is effective. The inventors surprisingly found out, while promoting discussions for a polymer compositing technique concerning the cellulose acetate and/or cellulose and an acrylonitrile based polymer, that the cellulose acetate and/or cellulose have/has a high deodorizing function with respect to a carboxylic acid, in particular to an acetic acid. Accordingly, it was suggested that by using the cellulose acetate and/or the cellulose as a constituent component of a fiber product, the deodorizing function can be realized by an ability of a fiber substrate itself without using a common deodorizing agent.

Furthermore, it was confirmed that an excellent moisture absorbing and retaining property, which was not provided in conventional acrylic based synthetic fibers, was obtained by using the cellulose acetate and/or cellulose and the acrylonitrile based polymer since high standard moisture regain of a fiber made of the cellulose, such as the cellulose acetate and cotton, could be effectively utilized. Therefore, it was also confirmed that by using the cellulose acetate and/or the cellulose as a constituent component of a fiber product, moisture absorbing and retaining performance could be realized by an ability of a fiber substrate itself without relying on a post process.

In the invention, cellulose diacetate and cellulose triacetate can be presented as the cellulose acetate. The cellulose diacetate in the invention has an average acetylation degree of 48.8% or more and less than 56.2%, and the cellulose triacetate has an average acetylation degree of 56.2% or more and less than 62.5%. The cellulose in the invention may be a polymer containing a cellulose molecular structure $C_6H_7O_2(OH)_3$, and it may be a cellulose derivative with a chemical modification added to a part of a hydroxyl group, such as alkyl cellulose, nitro cellulose, cellulose xanthate, and ion exchange cellulose as well.

In the invention, the acrylonitrile based polymer is made of acrylonitrile and an unsaturated monomer polymerizable therewith. As the unsaturated monomer, an acrylic acid, a methacrylic acid, alkyl esters thereof, vinyl acetate, acrylic amide, vinyl chloride, vinylidene chloride, and furthermore, depending on a purpose, an ionic unsaturated monomer such as sodium vinyl benzene sulfonate, sodium methacrylic sulfonate, sodium allyl sulfonate, sodium acrylic amide methyl propane sulfonate, and sodium parasulfophenol methacrylic ether may be used as well.

According to the composite fiber of the invention, the cellulose acetate and/or cellulose need to be 10 to 40% by weight, preferably 20 to 30% by weight. In the case where they are less than 10%, a feeling of a fiber becomes similar to that of the acrylic fiber and a dry feeling is lost. In addition, as to a deodorizing ratio of a deodorizing evaluation to be described later, a carboxylic acid is less than 90% and an acetic acid is less than 95%, and thus a high deodorizing ability cannot be obtained. In the case where they are more than 40%, spinability becomes poor, for example fiber breaks are generated at the time of production, and a fiber property is lowered, so that a process ability of yarn spinning becomes poor. Moreover, a soft feeling derived from the acrylic fiber is lost.

According to the invention, the acrylonitrile based polymer needs to be 60 to 90%, preferably 70 to 80% by weight. In the case where it is less than 60% by weight, the spinability becomes poor, and the fiber physical property is lowered, so that the spinning process passing property becomes poor. Moreover, the soft feeling derived form the acrylic fiber is lost. In the case where it is more than 90% by weight, a feeling of a fiber to be obtained becomes similar to the feeling of the acrylic fiber so that the dry feeling is lost.

According to the invention, it is important that, in a fiber cross section, the cellulose acetate and/or cellulose form an island component, and the acrylonitrile based polymer forms a sea component for obtaining the fiber physical property defined in the invention. By adopting the structure with the cellulose acetate and/or cellulose being the island component and the acrylonitrile based polymer being the sea component in the fiber cross section, circumference of the cellulose acetate and/or cellulose, which have vulnerable fiber properties, is covered with the acrylonitrile based polymer, and consequently the fiber is reinforced so as to obtain the fiber physical property equivalent to the ordinary acrylic fiber. Moreover, in order to obtain the fiber physical property equivalent to the ordinary acrylic fiber, a smaller island size is considered to be advantageous, however, as long as the fiber physical property defined in the invention is satisfied, the island size is not at all limited.

It is preferable that the sea island structure in the cross section in the direction perpendicular to the fiber axis (fiber lateral cross section) has the cellulose acetate and/or cellulose as the island component in the cross section in a fiber axis direction (fiber longitudinal cross section) communicating with another island component totally or partially for improving the deodorizing function.

In the invention, a vacant hole denotes a gap formed inside the fiber. A part of the vacant hole may be opened to a fiber surface, and moreover, the vacant hole may interlock the islands with each other. A form and a size of the vacant hole are not limited at all. Since it is preferable to maintain a fiber strength at 1.8 CN/dTex or more, those of about less than 2 to 5 μm are preferable though it depends on the form of the vacant hole. Furthermore, according to the invention, although a dense structure without a vacant hole inside the fiber is considered to be advantageous for maintaining the fiber physical property, existence or absence of the vacant hole is not at all limited as long as the fiber physical property defined in the invention is satisfied. In the case of an application for the purpose of retaining temperature and light weight, it is rather advantageous to provide the vacant hole.

As to the feeling of the fiber to be obtained, by satisfying a ratio of the longest diameter and the shortest diameter of the fiber cross section and a number of recess parts in a fiber cross section outer circumferential part, dry, tense, and soft feelings can be provided, which is different from conventional fibers, for example, cellulose acetate fiber, fibers made of cellulose such as cotton, rayon, cupra, or the like, and an acrylic fiber. In addition, it is also effective for the deodorizing.

That is, it is preferable that the ratio of the longest. diameter and the shortest diameter of the fiber cross section is 2 or less, and 5 or more recess parts of 0.3 μm or more and 3 μm or less width and 0.3 μm or more and 3 μm or less depth are provided in the fiber cross section outer circumferential part for the new feelings and improving the deodorizing effect. The longest diameter in the invention is a diameter of a circumscribing circle in contact with the fiber cross section outer circumferential part, and the shortest diameter is a diameter of a inscribed circle in contact with the fiber cross section outer circumferential part. The recess part in the fiber cross section outer circumferential part in the invention is a recess part recognizable visually with an optical microscope, having width and depth of 0.3 μm or more, which is the lowest limit of a wavelength area of visible light.

Moreover, the width and the depth of the recess part are 3 μm or less. If the recess part is in this range, since it is much smaller than a rain droplet diameter (100 μm to 3,000 μm), and it is much larger than water vapor (0.00044 μm) ("Special Functional Fiber" published by CMC, p182, 1983), only the water vapor can pass through the recess part and the water vapor can easily be diffused to the outside, and thus the dry feeling tends to be generated. Furthermore, depending on a number of existing recess parts, color effect which has not been conventionally provided can be expected.

Since the ratio of the longest diameter and the shortest diameter of the fiber cross section is 2 or less, bending rigidity is increased so as to provide an appropriate tense feeling, and since 5 or more recess parts of 0.3 μm or more and 3 μm or less width and 0.3 μm or more and 3 μm or less depth are provided in the fiber cross section outer circumferential part, the dry feeling is generated, and friction resistance between the fibers is reduced, so that the soft feeling can be provided. In the case where the ratio of the longest diameter and the shortest diameter of the fiber cross section is more than 2, the tense feeling is lost, and in the case where the recessed parts of 0.3 μm or more and 3 μm or less width and 0.3 μm or more and 3 μm or less depth are provided in the fiber cross section outer circumferential part are provided by less than 5, the dry feeling and the soft feeling tend to be lost.

According to the invention, single fiber strength is 1.8 CN/dTex or more, dry elongation is 30% or more, knot strength is 1.8 CN/dTex or more, and knot elongation is 30% or more. Within these ranges, in general, process ability of yarn spinning equivalent to that of ordinary acrylic fiber can be obtained. In the case where the defined fiber physical properties are not satisfied, that is, if the single fiber strength is less than 1.8 CN/dTex, the dry elongation is less than 30%, the knot strength is less than 1.8 CN/dTex, or the knot elongation is less than 30%, the process ability of yarn spinning becomes poor.

The carboxylic acid in the invention, any one having a carbonyl group in a molecule, and capable of being present in the air can be used. Moreover, the carboxylic acid may be any of a monocarboxylic acid, a dicarboxylic acid, and polycarboxylic acid, and it may be saturated or unsaturated. Furthermore, a structure having a functional group other than the carbonyl group may be used as well. Carboxylic acid species are not particularly limited as long as the above-mentioned conditions are satisfied. For example, those having an unpleasant strange odor or stimulus odor in a daily life, such as a formic acid, an acetic acid, a propionic acid, a lactic acid, an isolactic acid, a valeric acid, an isovaleric acid, a capronic acid, a 2-ethyl lactic acid, a capric acid, a 2-ethyl hexanic acid and an oleic acid, can be presented.

As to adsorption performance, it is important that a adsorption ratio of the carboxylic acid is 90% or more in the air including 100 ppm or less carboxylic acid by a measurement method to be described later. Carboxylic acid concentration in the air is set at 100 ppm as a practical evaluation density based on a daily life. In the case where the carboxylic acid adsorption ratio in the air including 100 ppm or less carboxylic acid is less than 90%, the adsorption ability is insufficient. Furthermore, in the case where the carboxylic acid adsorption ratio in the air including 100 ppm or less carboxylic acid is less than 90%, tolerant concentration of the acetic acid as a representative example of the stimulus odor of the carboxylic acid species, which is 10 ppm, (Principal Chemical Products 1,000 Kinds Toxicity Data Special Research Report, p19, Kaigai Gijutsu Shiryo Kenkyusho, 1973) cannot be satisfied. According to the invention, since the deodorizing ratio with respect to the acetic acid is 95% or more, the tolerance concentration can be satisfied sufficiently. In the case where the deodorizing ratio of the acetic acid is less than 90%, an adsorption ability tends to be insufficient.

In the invention, the air including the carboxylic acid is not at all limited as to inclusion of another gas component species as long as a single or composite carboxylic acid species is/are provided as a part of constituent components in the air, and the carboxylic acid is 100 ppm or less. A mechanism of the excellent deodorizing property of the cellulose acetate and/or cellulose is not clear yet at the present, however, the inventors assume that a hydrophilic group of the cellulose acetate and/or cellulose and an acetyl group of a cellulose acetate side chain are related thereto. That is, a carboxylic group has a hydrophobic part and a hydrophilic part in a molecule, and it is assumed that the hydrophobic part thereof is adsorbed to the acetyl group of the cellulose acetate side chain, and on the other hand, the hydrophilic part is adsorbed to the cellulose acetate and/or cellulose via an affinity with a water molecule so as to realize an excellent deodorizing ability.

Then, according to the invention, the cellulose acetate and/or cellulose have/has a particularly high deodorizing ability with respect to the acetic acid. The reason thereof is presumed that the acetyl group in the acetic acid and the acetyl group of the cellulose acetate side chain have stronger affinities. Since the invention has the deodorizing property for a nonenal as an aldehyde compound, with a premise that the above-mentioned mechanism is correct, it is easily presumed that the same deodorizing ability can be also realized with respect to a substance in the air having a hydrophobic part and a hydrophilic part in a molecule. In the case where the deodorizing ratio of the nonanal is less than 90%, the adsorption ability tends to be insufficient. Preferably, the deodorizing ratio is 95% and more According to the invention, it is important that a moisture absorbing ratio Aa under a 40° C. temperature and 90% RH humidity environment is 15.0% or less, and a moisture absorbing ratio Ab under the 20° C. temperature and 65% RH humidity environment is more than 2% in terms of appropriate supply of a moisture absorbing property. That is, as to the moisture absorbing ratio of the invention, Ab under an average temperature and humidity environment is more than 2%, and Aa under a high temperature and high humidity environment is 15.0% or less equivalent to the standard moisture regain of wool as a natural fiber ,which is 15%, ("Fiber handbook 2001", edited by Nihon Kagaku Senni Kyokai, published in December 2000), and thus the moisture absorbing property with little sticky feeling can be obtained.

Although a desired moisture absorbing property can be obtained by optionally setting a mixing ratio of the acrylic based composite fiber according to the invention in a fiber product to be obtained, preferably the moisture absorbing ratio Aa is 3.0% or more and 8.0% or less (less than 8.5%, which is the standard moisture regain of cotton as a representative of a natural fiber). In the case where it is less than 3.0%, a sufficient moisture absorbing property tends not to be obtained. Moreover, the moisture absorbing ratio Ab is preferably more than 2.0% and less than 6.5%. In the case where Ab is 2.0% or less, the sufficient moisture absorbing property tends to be hardly obtained. In the case of realizing the moisture absorbing property of 6.5% or more, content of the cellulose acetate and/or cellulose needs to be increased, so that the physical properties such as the fiber strength tend to be lowered.

According to the invention, it is important that a moisture absorbing ratio difference ΔA (=Ab−Aa) at the time of transfer from the temperature 40% and 90% RH humidity environment to the 20° C. and 65% RH humidity environment is 1.5 or less in terms of the supply of a moisture retaining property. That is, it is important that the moisture absorbing ratio difference ΔA at the time of transfer from the high temperature and humidity environment to the average temperature and humidity environment satisfies 1.5 or less in terms of keeping the moisture retaining property uninfluenced by environment conditions. In the case where ΔA is more than 1.5, the moisture retaining property becomes poor. Therefore, since an appropriate moisture absorbing property and a moisture retaining property are provided under the different environment conditions in the invention, the moisture absorbing and retaining properties uninfluenced by the environment conditions can be obtained. This means that the moisture retaining property with little sticky feeling can be obtained stably even in the case of an external environment change in the summer or winter, or a high temperature and high humidity environment in clothes immediately after physical exercises.

Furthermore, surprisingly, depending on a ratio of the cellulose acetate and/or cellulose and the acrylonitrile based polymer, the acrylic based composite fiber of the invention can obtain the moisture absorbing ratio of 3.5% or more, which is the standard moisture regain of a triacetate fiber, or the ratio equivalent to the standard moisture regain of a diacetate fiber, which is 6.5%, and of wool, which is 15.0% ("Fiber handbook 2001", edited by Nihon Kagaku Senni Kyokai, published in December 2000). This means that in the case where the ratio of the cellulose acetate and/or cellulose and the acrylonitrile based polymer is same, it tends to be higher than the moisture absorbing ratio obtained from a mixture of a fiber of the cellulose acetate and/or the cellulose and a fiber of the acrylonitrile based polymer (for example, a cloth using a blended fiber, a knitted or woven product obtained by cross knitting or cross weaving fibers spun independently, or a pile product obtained directly by tufting from a sliver without forming a spun yarn, such as a blanket, or the like). Although a mechanism is not clear at the present, it is presumed that an increase of interfaces between the cellulose acetate and/or cellulose and the acrylonitrile based polymer obtained by the sea island structure is related.

A fiber composite using the acrylic based composite fiber of the invention, such as a woven or knitted product and a non-woven fabric, has a novel feeling, the deodorizing property and the moisture absorbing and retaining property, which have not been provided conventionally and it may be a fiber composite including 20% by weight or more of the acrylic based composite fiber of the invention, preferably 30% or more. Not only being processed in a spun yarn made of only the acrylic based composite fiber of the invention, it may be also mixed with a synthetic fiber or a semi synthetic fiber such as an ordinary acrylic fiber, a polyester fiber, polyamide fiber and rayon short fiber, and/or cotton, ram wool, or the like. Moreover, it may be cross knit or cross woven with a long fiber such as the above-mentioned synthetic fiber or the semi synthetic fiber and silk. In particular, cloth obtained by mixing, cross knitting or cross weaving with rayon or ram wool is provided with a unique feeling, and it is effective in deodorizing not only an acetic acid odor but also an ammonium odor.

The fiber composite such as the woven or knitted product or the non-woven fabric using the acrylic composite fiber according to the invention has a novel feeling and moisture absorbing and retaining property, which have not been provided conventionally. It may be provided as a fiber composite including 20% by weight or more of the acrylic based composite fiber of the invention, preferably 30% by weight or more, and further preferably 50% by weight or more in view of obtainment of a mixing homogeneity. Moreover, the fiber composite using the fiber of the invention is not limited to the woven or knitted product and the non-woven fabric, and it is needless to say that it can be also applied to a fiber composite such as a pile.

As end use of the fiber composite using the acrylic based composite fiber of the invention, clothing applications such as a sweater, an inner, a shirt, socks, a jersey, and a skirt, bedding applications such as a blanket and a sheet, interior applications such as a carpet, a mat, a chair covering and a curtain, miscellaneous applications such as toiletry goods, an artificial fur, and a stuffed animal, and an application for handicraft thread, or the like can be presented.

The fiber of the invention can be produced for example as follows. First, an acrylic based composite fiber of the invention comprising the cellulose acetate and the acrylonitrile based polymer is obtained, and next, an acrylic based composite fiber of the invention comprising the cellulose acetate, the cellulose and the acrylonitrile based polymer is obtained, and furthermore, an acrylic based composite fiber of the invention comprising the cellulose and the acrylonitrile based polymer is obtained. Hereinafter, it will be explained successively.

A spinning solution made of cellulose acetate, an acrylonitrile based polymer and a solvent is prepared. The solvent is not particularly limited as long as it is a solvent capable of dissolving both the cellulose acetate and the acrylonitrile based polymer. And any of an inorganic acid based one, an inorganic base aqueous solution based one, and an organic solvent can be used. As the solvent, for example, a nitric acid (aqueous solution), a zinc chloride aqueous solution, a rhodanide aqueous solution, dimethyl formamide, dimethyl acetamide, dimethyl sulfoxide, ethylene carbonate, propylene carbonate, γ-butylolactone, acetone, or the like can be presented.

As to a method for preparing the spinning solution, it may be adjusted by agitating and mixing the cellulose acetate, the acrylonitrile based polymer and the solvent at the same time at a room temperature, or by heating or cooling as needed, however, it is also possible to dissolve the cellulose acetate and the acrylonitrile based polymer independently in the solvent and mix them.

In order to obtain the acrylic based composite fiber made of the cellulose acetate and the acrylonitrile based polymer, having a fiber structure with the cellulose acetate as the island component and the acrylonitrile based polymer as the sea component in the cross section in the direction perpendicular to the fiber axis according to the invention, a wet spinning method is used, which provides easy controllability of a coagulation speed of the spinning solution for forming the recess parts in the fiber cross section outer circumferential part. Since the coagulation speed by a dry jet wet spinning method and a dry spinning method other than the wet spinning method is slow, the recess part formation in the fiber cross section outer circumferential part becomes difficult.

The spinning solution is made into a coagulated filament using an ordinary spinnerette, and it is drawn to 3 to 7 times drawing ratio. In the case where the drawing ratio is less than 3 times, mechanical strength of the fiber is lowered, so that spinability and product durability are lowered. In the case where the drawing ratio is more than 7 times, process troubles such as+++ a thread break can be easily generated. An oiling process and a drying process are applied to a drawn thread by an ordinary method. In this production method of the invention, functional materials, for example, a fluorine based compound including a pollution preventive substance, an amine based compound or natural based substances such as a chitin and a chitosan having an antibacterial activity, can be applied to a thread before drying and collapsing processes (a coagulated thread, a washed thread and a drawn thread).

The composite fiber made of the cellulose acetate and the acrylonitrile based polymer of the invention accordingly obtained becomes an acrylonitrile based composite fiber with a totally novel feeling, which has not been provided in a conventional cellulose acetate fiber, a cellulose fiber or an acrylic fiber, and an excellent spinability, fiber physical property, process ability of the (yarn) spinning, deodorizing property and moisture retaining property by having the composite ratio, the ratio of the longest diameter and the shortest diameter in the fiber cross section, the size and the number of the recess parts in the fiber cross section outer circumferential part each at a desired value by changing a mixing ratio of the components cellulose acetate (A) and acrylonitrile based polymer (B), a ratio of the longest diameter and the shortest diameter of a spinnerette hole and a coagulation condition in spinning.

Furthermore, by further processing the composite fiber of the cellulose acetate and the acrylonitrile based polymer of the invention obtained as mentioned above by a heating process under alkali, for example, a process with a sodium hydroxide of 12% concentration at 60° C. for about 30 minutes with a cotton dyeing machine, a cheese dyeing machine, a hank dyeing machine, or the like, the cellulose acetate becomes cellulose, so that the acrylonitrile based composite fiber made of the cellulose acetate ,the cellulose and the acrylonitrile based polymer of the invention, having the excellent moisture absorbing property, can be obtained. Moreover, depending on the concentration of the sodium hydroxide or the processing condition, the acrylonitrile based composite fiber made of the cellulose and the acrylonitrile based polymer of the invention can be obtained. Although an alkaline agent to be used is not particularly limited, it is preferable to use a strong alkaline such as the sodium hydroxide.

Moreover, since the moisture absorbing and retaining performance is improved by the cellulose process, the mixing ratio of the fiber of invention in an end use product can be lowered, and the mixing ratio of another functional fiber can be increased. Therefore a product application for end use can be widened. Furthermore, it is also effective in terms of widening of the product application for end use to apply a chemical modification to a part of the hydroxyl group after the cellulose process so as to have a cellulose derivative, such as alkyl cellulose, nitro cellulose, cellulose xanthane, and ion exchange cellulose.

BEST MODE FOR CARRYING OUT THE INVENTION

Figure 1:
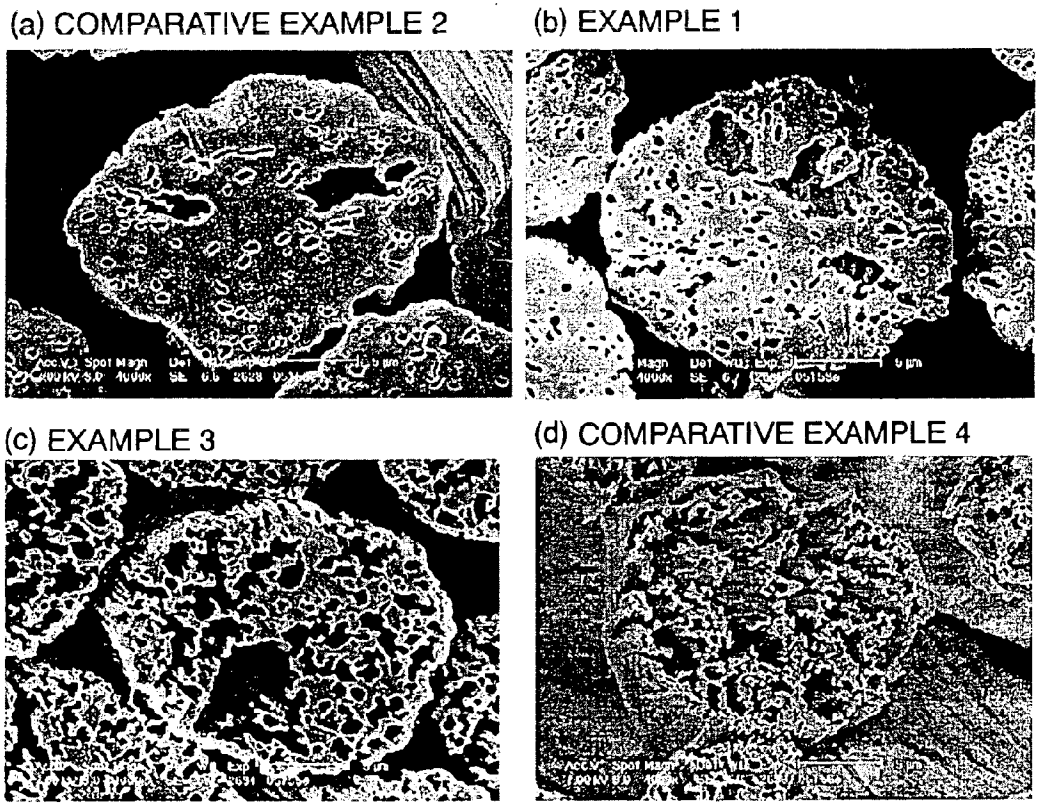
FIG. 1 is a set of electron microscope photographs of lateral cross sectional views of each fiber of Examples 1 and 3 according to the invention and Comparative examples 2 and 4.

Hereinafter, embodiments of the invention will be explained further specifically based on representative examples.

In the examples below, the phrase "% by weight" is indicated simply as "%".

(Ratio of the Longest Diameter and the Shortest Diameter in a Fiber Cross Section and a Number of Recess Parts in a Fiber Cross Section Outer Circumferential Part)

After wrapping a fiber bundle in a paraffin resin, and cutting to a 5 $\mu$m thin layer with a microtome, a cut surface was observed with a transmission type optical microscope (produced by Nikon Corp., biological microscope E-800), so that a number of the recess parts of 0.3 $\mu$m or more and 3 $\mu$m or less width and 0.3 $\mu$m or more and 3 $\mu$m or less depth in a fiber cross section outer circumferential part was counted by visual observation.

(Observation Method for a Sea Island Structure)

After wrapping a fiber bundle in a two-liquid-type urethane resin, and cutting to 2 mm length with a safety razor, an ion plasma etching process was applied to a cut surface with a plasma reactor (produced by Yamato Kagaku Corp., PR-302). After applying metal sputtering to a processed surface by an ordinary method, it was observed with a scanning type electron microscope (produced by Nihon Denshi Corp., JSM-T20).

(Single Fiber Strength, Dry Elongation, Knot Strength and Knot Elongation)

Methods of 8.7 (tensile strength and a stretching ratio) and 8.8 (knot strength) of JIS L 1015 were used to test a chemical fiber staple.

(Feeling Evaluation)

Dry, tense and soft feelings were evaluated by a sensory test by touching with hands.

(Deodorizing Ratio)

As odor components for a deodorizing evaluation, an isovaleric acid and an acetic acid as representative odors of a carboxylic acid, and a nonenal ($C_6H_{19}O$) as an aldehyde compound were selected.

1 g of a specimen left still under a 20° C. temperature and 65% RH humidity environment for 24 hours was sealed in a 370 mL triangular flask adjusted so as to have a 50 ppm gas concentration of the isovaleric acid or the acetic acid. After leaving for 1 hour, the gas concentration in the flask was measured with a detector tube (Kitagawa type gas detector). For a comparison, measurement was made in the same manner except that the specimen was not sealed for obtaining the gas concentration in the flask after leaving for 1 hour.

A deodorizing ratio was calculated as a ratio of the gas concentration with the specimen sealed with respect to the gas concentration of the comparison.

In the case of an ammonium as the odor component of the deodorizing evaluation, it was evaluated in the same manner except that ammonium gas concentration was adjusted to 110 ppm in the above-mentioned evaluation method.

In the case of the nonenal as the odor component of the deodorizing evaluation, 1 g of a specimen left still under a 20° C. temperature and 65% RH humidity environment for 24 hours was sealed in a 125 mL glass Bayer bottle adjusted so as to have a 30 ppm gas concentration of the nonenal. After leaving for 2 hours, a nonenal gas concentration was measured with a gas chromatograph. For a comparison, measurement was made in the same manner except that the specimen was not sealed for obtaining a relative deodorizing ratio from a peak area of a gas chromatography.

(Moisture Absorbing Ratio)

After leaving 5 g of a specimen under a 40° C. temperature and 90% RH humidity environment for 24 hours, it was collected for measuring a mass and an absolute dry mass thereof. By the following formula, a moisture absorbing ratio Aa (%) was calculated. In the same manner, a moisture absorbing ratio Ab of the same evaluation method except that it is under a 20° C. temperature and a 65% humidity environment was also calculated by the following formula.

$$\text{Moisture absorbing ratio } (Aa \text{ or } Ab) = (\text{mass at the time of collection} - \text{absolute dry mass})/\text{absolute dry mass} \times 100$$

(Cellulose Acetate Weight Reduction Ratio)

After soaking a specimen in an acetone and applying a heat treatment at 70° C. for 20 minutes, it was washed and dried absolutely for measuring its weight. In the case where cellulose acetate is included in the specimen, since the cellulose acetate is extracted by the acetone, the weight is reduced. However, in the case where the cellulose acetate is changed into cellulose, weight change does not take place. The weight change before and after the acetone extracting process was provided as a cellulose acetate weight reduction ratio.

Hereinafter, with reference to Examples and Comparative examples of the invention, characteristics will be compared.

"Spinability, feeling and deodorizing property of Examples 1 to 5 and Comparative examples 1 to 5"

Spinning solutions were obtained by mixing and dissolving a cellulose diacetate (A) having a 55.2% average acetylation degree and an acrylonitrile based polymer (B) (acrylonitrile/vinyl acetate=93/7 by weight ratio) having a 1.98 reduction viscosity of a 0.5% dimethyl formamide measurement obtained by aqueous dispersion polymerization method with solid component ratios shown in Table 1 in a dimethyl acetamide so as to have a 22% solid component concentration. The spinning solutions were discharged into a spinning bath consisting of 56% dimethylacetamide aqueous solution at 35° C. using a round shape spinarette and drawn to 6 times while washing with boiling water to prepare drawn filaments. After that, the filaments were dried and annealed to prepare fiber with a monofilament fineness of 2.2 dTex.

Evaluation on the fibers with different solid component ratios of (A)/(B) in terms of spinability, existence or absence of a sea island structure, a ratio of the longest diameter and the shortest diameter of a fiber cross section, a number of recess parts of 0.3 μm or more and 3 μm or less width and 0.3 μm or more and 3 μm or less depth generated in a fiber cross section outer circumferential part, feeling, and a deodorizing property for a isovaleric acid and an acetic acid, is shown in Table 1. Moreover, a spinnerette with round shape holes was used except a case of Example 4 using a spinnerette with elliptical shape holes that has a 2.0 ratio of a longer axis and a shorter axis. The deodorizing property with respect to a nonenal was evaluated for a composite fiber obtained in Example 3 (single fiber fineness 2.2 dTex) and an acrylic fiber (single fiber fineness 2.2 dTex). Deodorizing ratios were 95% and 38% respectively. Moreover, moisture absorbing and retaining property evaluation for fibers used in Examples 1, 3, 5 and Comparative examples 1, 2 is shown in Table 2.

From these figures, it is understood that a fiber component of the cellulose diacetate (A) and the acrylonitrile based polymer (B) constitute a composite fiber having a sea island structure with the acrylonitrile based polymer (B) providing a sea component and the cellulose diacetate (A) providing an island component, and the cellulose diacetate (A) elongates in a fiber direction, partially communicating with another island component. Furthermore, the cellulose diacetate (A) component existing on a surface is extracted into the spinning bath, and it forms recess parts in the fiber surface according to a difference of coagulation speed between the cellulose diacetate (A) and the acrylonitrile based polymer (B).

Therefore, by changing the solid component ratio (A)/(B) of the cellulose diacetate (A) and the acrylonitrile based polymer (B), a volume of the cellulose diacetate (A) existing in the acrylonitrile based polymer (B), and a size and a number of the recess parts in the surface of the composite fiber can be controlled.

TABLE 1

| | (A)/(B) solid component ratio | Spinability | Existence/ absence of sea island structure | Ratio of longest diameter and shortest diameter | Number of recess parts | Feeling | | | Deodorizing ratio | |
|---|---|---|---|---|---|---|---|---|---|---|
| | | | | | | Dry feeling | Tense feeling | Soft feeling | Isovaleric acid | Acetic acid |
| Comparative example 1 | 0/100 | Good | Absent | 2.0 | 1 | Poor | Good | Good | 54 | 54 |
| Comparative example 2 | 5/95 | Good | Exist | 1.5 | 4 | Poor | Good | Good | 73 | 74 |
| Example 1 | 10/90 | Good | Exist | 1.4 | 5 | Slightly good | Good | Good | 90 | 95 |
| Example 2 | 15/85 | Good | Exist | 1.4 | 6 | Good | Good | Good | 91 | 96 |
| Example 3 | 30/70 | Good | Exist | 1.3 | 9 | Good | Good | Good | 93 | 98 |
| Example 4 | 30/70 | Good | Exist | 2.0 | 8 | Good | Good | Good | 92 | 97 |
| Comparative example 3 | 30/70 | Good | Exist | 2.5 | 10 | Good | Poor | Good | 92 | 97 |
| Example 5 | 40/60 | Good | Exist | 1.2 | 7 | Good | Good | Good | 94 | 98 |
| Comparative example 4 | 50/50 | Poor | — | — | — | — | — | — | — | — |
| Comparative example 5 | 100/0 | Good | Absent | 2.0 | 5 | Good | Slightly good | Slightly poor | 95 | 98 |

TABLE 2

| | (A)/(B) solid component ratio | Moisture absorbing ratio Aa (%) | Moisture absorbing ratio Ab (%) | ΔA |
|---|---|---|---|---|
| Comparative example 1 | 0/100 | 2.4 | 1.2 | 1.2 |
| Comparative example 2 | 5/95 | 3.1 | 1.9 | 1.2 |
| Example 1 | 10/90 | 4.2 | 2.8 | 1.4 |
| Example 3 | 30/70 | 6.3 | 5.0 | 1.3 |
| Example 5 | 40/60 | 7.7 | 6.3 | 1.4 |

Figure 2:
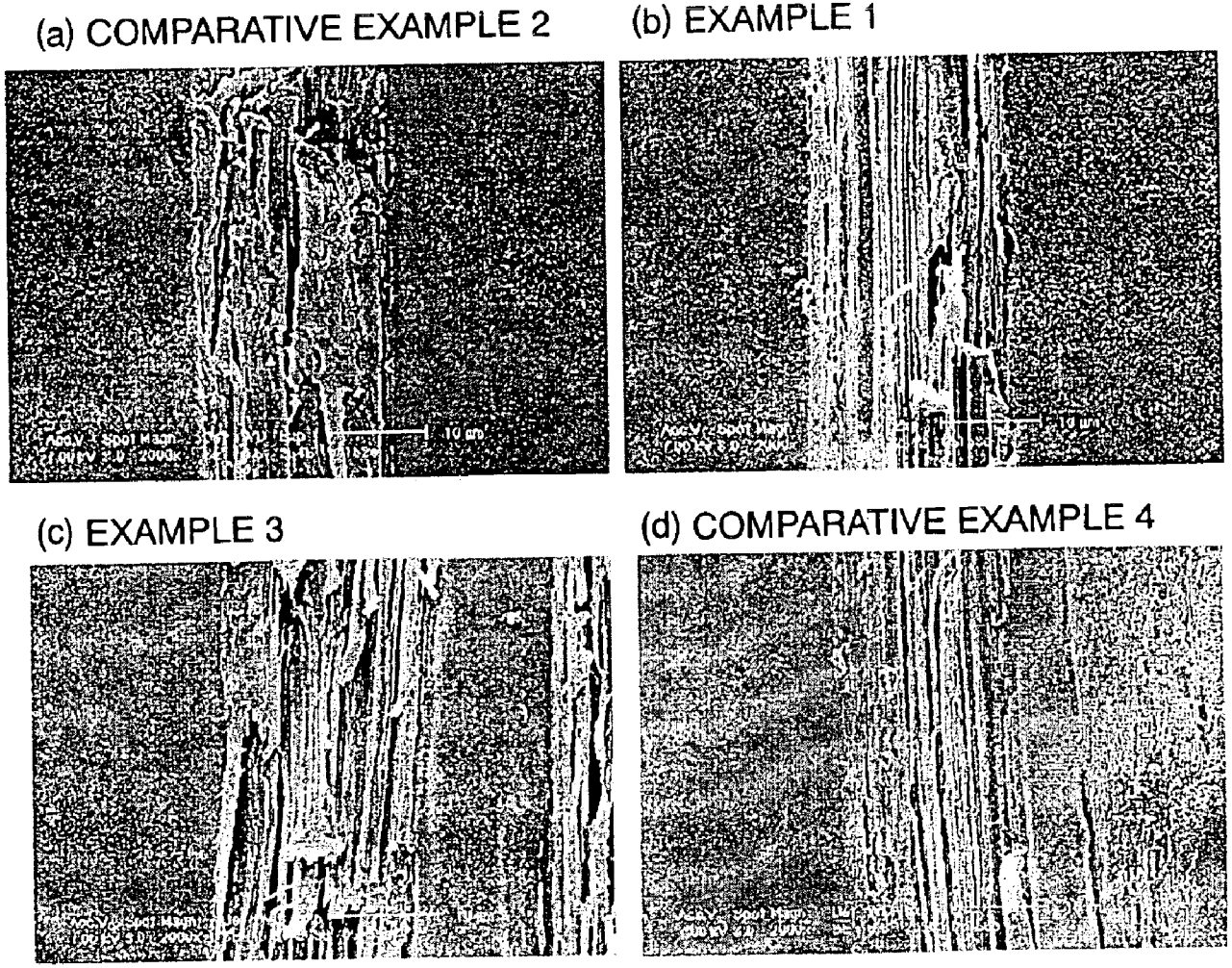
FIG. 2 is a set of longitudinal cross sectional views of the same.

FIGS. 1(*a*) to 1(*d*) show a lateral cross section of each fiber obtained by Example 1 and 3, and Comparative examples 2 and 4 by scanning electron microscope photographs successively. Moreover, FIGS. 2(*a*) to 2(*d*) show a vertical cross section of each fiber corresponding to the same examples by scanning type electron photographs successively. These fibers were soaked in an acetone at 70° C. for 30 minutes for extracting cellulose diacetate components in the fibers, and an ion plasma etching process was applied thereto for 90 seconds for executing a metal spattering on processed surfaces thereof.

For Example 4 and Comparative examples 1, 3 and 5 in Table 1, evaluation was executed for the fibers obtained in the same conditions as those of another examples and the comparative examples except that a hole shape of the spinnelette was changed from a round type to an elliptical type to prepare the fiber with a ratio of the longest diameter and the shortest diameter as shown in Table 1.

In the case of Comparative example 4 with the (A)/(B) solid component ratio of 50/50, the fiber cannot be obtained stably because filament breaks were generated frequently at the spinning process. Therefore, execution of the evaluation thereof was impossible as well.

As it is understood from Table 1, even in the case where the ratio of the longest diameter and the shortest diameter of the composite fiber is 2, if the number of the recess parts appearing on the fiber surface is 4 or less, a dry feeling is poor, and deodorizing performance with respect to the isovaleric acid and the acetic acid is low.

Moreover, as to a feeling evaluation for a commercially available cellulose diacetate 100% fiber as Comparative example 5 (produced by Mitsubishi Rayon Corp. "Linda" 3.3 dTex), although the dry feeling and the tense feeling were equivalent to those of the acrylic based composite fiber of the invention, the soft feeling was poor compared with the acrylic based composite fiber of the invention.

Process Ability of Yarn Spinning of Examples 1, 3, 5 and Comparative Example 6

Next, for the composite fibers of the above-mentioned Examples 1, 3, and 5 and Comparative example 6, strength, dry elongation, knot strength, knot elongation and process ability of yarn spinning of each single fiber were evaluated. Results are shown in Table 3. Here, the composite fiber of Comparative example 6 was produced in the same conditions as the Comparative example 4 except that the drawing ratio was changed to 3 times.

As to the evaluation of the process ability of yarn spinning, spun yarn of a 2/32 yarn number count were produced by cutting the composite fibers of Example 1, 3, and 5 and the new comparative example 6 having the different (A)/(B) solid component ratios to 51 mm, and mixing with an ordinary acrylic fiber of 2.2 dTex and a 51 mm fiber length at 30/70 mixing ratio.

TABLE 3

| | Solid component mixing ratio of A/B | Single fiber strength | Dry elongation | Knot strength | Knot elongation | Process ability of yarn Spinning |
|---|---|---|---|---|---|---|
| Example 1 | 10/90 | 2.3 | 41.5 | 2.2 | 41.0 | Good |
| Example 3 | 30/70 | 2.2 | 41.0 | 2.0 | 38.0 | Good |
| Example 5 | 40/60 | 1.9 | 32.5 | 1.8 | 31.0 | Good |
| Comparative example 6 | 50/50 | 1.3 | 26.0 | 1.4 | 24.5 | Poor |

As it is apparent from Table 3, there is no problem in the process ability of yarn spinning for Examples 1 and 3. As to the process ability of yarn spinning with the (A)/(B) solid component ratio of 40/60 (Example 5), although fly is generated slightly, it was at a level substantially without a problem. In contrast, in the case of Comparative example 6 with the (A)/(B) solid component ratio of 50/50, the spinability is poor (for example the filament breaks were generated frequently at the spinning process). Moreover, the process ability of yarn spinning was poor. (Fly is generated.)

From this, it was learned that the process ability of yarn spinning equal to that of an ordinary acrylic fiber spinning process can be obtained as long as the single fiber strength of the above-mentioned composite fiber is 1.8 CN/dTex or more, the dry elongation is 30% or more, the knot strength is 1.8 CN/dTex or more and the knot elongation is 30% or more. In the case where these values are not satisfied as in the case of the composite fiber of Comparative example 6, the process ability of yarn spinning becomes poor.

"Deodorizing Property of Each Kind of Spun Yarn with Respect to an Acetic Acid, an Ammonia and a Nonenal"

Knitted fabric of a plain stitch organization was knitted after cutting the composite fiber obtained in Example 3 (single fiber fineness 2.2 dTex), the acrylic fiber (single fiber fineness 2.2 dTex), rayon (single fiber fineness 1.3 dTex), and ram wool (64S) each by 51 mm, and mixing by the mixing ratio shown in Table 4, and producing spun yarns of a 1/52 yarn number. On the other hand, a dyeing liquid was prepared by adding 0.25 g of a dye (Hodoya Kagaku Corp., Kachiron Blue KGLH), 1 g of an acetic acid, and 0.25 g of a sodium acetate to 1,000 g of pure water. The dyeing liquid was heated to 100° C. 50 g of the above-mentioned knitted fabric was soaked in the dyeing liquid and maintained at 100° C. for 30 minutes. After that, the dyed fabric was washed with water, dehydrated and dried, and a cation dyeing was executed. The deodorizing property of these fabrics with respect to an acetic acid and ammonia were evaluated. Results are shown in Table 4. The deodorizing property of the knitted fabrics of Example 6 and Comparative example 7 with respect to a nonenal was evaluated. The deodorizing ratios were 90% and 38% respectively.

TABLE 4

| | Mixing ratio | | | | Deodorizing ratio (%) | |
|---|---|---|---|---|---|---|
| | Fiber obtained in Example 3 | Acrylic fiber | Rayon | Wool | Acetic acid | Ammonia |
| Comparative example 7 | 0 | 100 | 0 | 0 | 54 | 54 |
| Example 6 | 30 | 70 | 0 | 0 | 95 | 79 |
| Example 7 | 30 | 40 | 30 | 0 | 97 | 94 |
| Example 8 | 30 | 40 | 0 | 30 | 96 | 97 |

As it is apparent from Table 4, the deodorizing property of the knitted fabric made of an ordinary acrylic fiber (Comparative example 7) was not at all satisfactory. In contrast, in the case that the mixed knitted fabric of the composite fiber of Example 3 and the acrylic fiber, although the deodorizing property of the fabric has slightly low evaluation in the deodorizing property with respect to the ammonia, it is no problem in a practical use. Besides, since it has high deodorizing property evaluation with respect to the acetic acid, it is easily understandable that the composite fiber of the invention has the excellent deodorizing property as well.

"Moisture Absorbing and Retaining Property of Each Kind of Spun Yarn"

Figure 3:
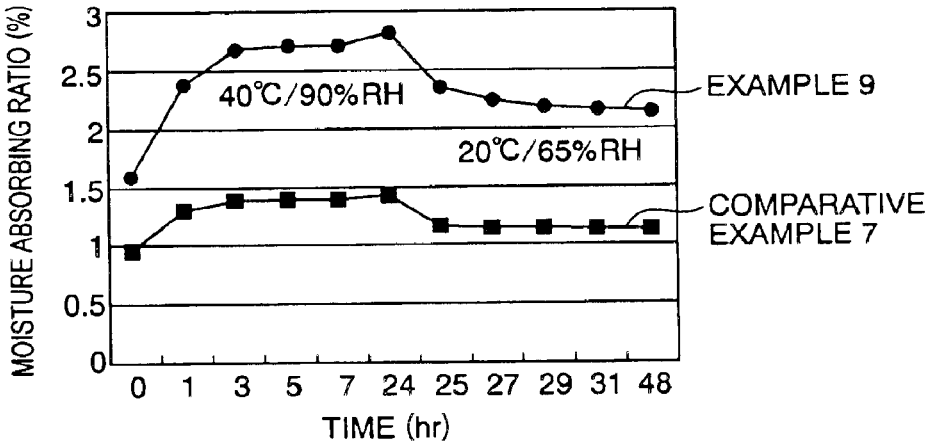
FIG. 3 is a graph showing evaluation results of moisture absorbing properties of fibers of Example 9 and Comparative example 7.

Knitted fabric of a plain stitch organization was knitted after cutting the composite fiber obtained in Example 3 (single fiber fineness 2.2 dTex) and the acrylic fiber (single fiber fineness 2.2 dTex) each by 51 mm, and mixing them by a 50/50 mixing ratio, and producing spun yarns of a 1/52 yarn number. Thereafter, a knitted fabric with the above-mentioned cation dyeing was obtained (Example 9). After leaving the knitted fabric and a knitted fabric made of an ordinary acrylic fiber (Comparative example 7) in a 20° C. temperature and 65% RH humidity environment for 4 hours, they were left in a 40° C. temperature and 90% Rh humidity environment for 24 hours and successively left in a 20° C. temperature and 65% RH humidity environment for 24 hours, then, the moisture absorbing and retaining property of each knitted fabric was evaluated. Results are shown in FIG. 3.

Example 9 was superior to the acrylic fiber knitted fabric (Comparative example 7), and it has a sufficient moisture absorbing and retaining property in the different environment conditions. The moisture absorbing property was evaluated for a mixed spun yarn of a tow of the cellulose diacetate (single fiber fineness 2.2 dTex) and a tow of the acrylic fiber (single fiber fineness 2.2 dTex) at 15/85 ratio, paralleled by a sliver after leaving it in a 20° C. temperature and 65% RH humidity environment for 24 hours. The moisture absorbing property was 1.8%, which is poorer than that of Example 9.

Moisture Absorbing Property of Examples 10 to 11 and Comparative Examples 8 to 10

To prepare samples of Examples 10 and 11, the fibers obtained in Examples 3 and 4 were treated with different concentration of NaOH respectively for 30 minutes at 60° C. In the case of Comparative examples 8 and 9, the fiber obtained in Comparative example 1 was treated with different concentration of NaOH for 30 minutes at 60°. In the case of Comparative example 10, the fiber obtained in Comparative example 2 was treated with NaOH which using amount is 12wt % per fiber weight under the same temperature. Evaluation on the moisture absorbing property, the weight reduction ratio of the obtained fibers is shown in Table 5. In the acrylic based composite fibers of Examples 10 and 11, the cellulose acetate, the cellulose and the acrylic based polymer were present. Although the cellulose acetate, the cellulose and the acrylonitrile based polymer were similarly present in the acrylic based composite fiber in Comparative example 10, satisfactory performance was not obtained because the cellulose diacetate is 5%.

Moisture Absorbing Property of Example 12

To prepare the sample of Example 12, the fiber obtained in Examples 5 was treated with NaOH of which using amount is 14wt % per fiber weight for 30 minutes at 80° C. The cellulose acetate was changed to be the cellulose by an alkaline process so that the cellulose and the acrylonitrile based polymer were present in the acrylic based composite fiber. Evaluation on the moisture absorbing property and the weight reduction ratio of the obtained fiber is shown in Table 5.

TABLE 5

| | Specimen No. supplied for NaOH use | Solid component mixing ratio of A/B | Using amount of NaOH (% with respect to fiber weight) | Moisture absorbing ratio Aa (%) | Moisture absorbing ratio Ab (%) | ΔA | Cellulose acetate weight reduction ratio (%) |
|---|---|---|---|---|---|---|---|
| Example 10 | Example 3 | 30/70 | 12 | 8.1 | 6.8 | 1.2 | 30 |
| Example 11 | Example 3 | 30/70 | 3 | 4.8 | 3.2 | 1.2 | 11 |
| Example 12 | Example 5 | 40/60 | 14 | 13.0 | 11.6 | 1.4 | 40 |
| Comparative example 8 | Comparative example 1 | 0/100 | 3 | 1.5 | 1.2 | 0.3 | 0 |
| Comparative example 9 | Comparative example 1 | 0/100 | 0 | 1.5 | 1.2 | 0.3 | 0 |
| Comparative example 10 | Comparative example 2 | 5/95 | 12 | 2.5 | 1.8 | 0.7 | 30 |

What is claimed is:

1. An acrylic based composite fiber comprising 10 to 40% by weight of at least one of cellulose acetate or cellulose and 60 to 90% by weight of an acrylonitrile based polymer, said acrylic based composite fiber having a structure wherein at least one of the cellulose acetate or cellulose is present as an island component in a cross section perpendicular to a fiber axis, and the acrylonitrile based polymer is present as a sea component, and single fiber strength is 1.8 CN/dTex or more, dry elongation is 30% or more, knot strength is 1.8 CN/dTex or more, and knot elongation is 30% or more.

2. The acrylic based composite fiber according to claim 1, having a structure wherein at least one of the cellulose acetate or cellulose is present as the island component and contacts another island component in a cross section along the fiber axis direction.

3. The acrylic based composite fiber according to claim 1, wherein a vacant hole is present inside the fiber.

4. The acrylic based composite fiber according to claim 1, wherein a ratio of the longest diameter and the shortest diameter of a fiber cross section is 2 or less, and 5 or more recess parts of from 0.3 μm to 3 μm width and from 0.3 μm to 3 μm depth are present in a fiber cross section outer circumferential part.

5. The acrylic based composite fiber according to claim 1, having a deodorizing ratio with respect to a carboxylic acid of 90% or more.

6. The acrylic based composite fiber according to claim 1, having a deodorizing ratio with respect to an acetic acid of 95% or more.

7. The acrylic based composite fiber according to claim 1, having a deodorizing ratio with respect to a nonanal of 90% or more.

8. The acrylic based composite fiber according to claim 1, having a moisture absorbing ratio Aa at a 40° C. temperature and 90% RH humidity environment of 15.0% or less, a moisture absorbing ratio Ab at a 20° C. temperature and 65% RH humidity environment of more than 2%, and a moisture absorbing ratio difference ΔA (=Aa−Ab) at the time of transfer from the 40° C. temperature and 90% RH humidity environment to the 20° C. temperature and 65% RH humidity environment of less than 1.5.

9. The acrylic based composite fiber according to claim 8, wherein the moisture absorbing ratio Aa at the 40° C. temperature and 90% RH humidity environment is from 3.0% to 8.0%, and the moisture absorbing ratio Ab at the 20° C. temperature and 65% RH humidity environment is more than 2% and less than 6.5%.

10. A fiber composite comprising the acrylic based composite fiber according to claim 1.

11. The acrylic based composite fiber according to claim 2, wherein a vacant hole is present inside the fiber.

12. The acrylic based composite fiber according to claim 2, wherein a ratio of the longest diameter and the shortest diameter of a fiber cross section is 2 or less, and 5 or more recess parts of from 0.3 μm to 3 μm width from 0.3 μm to 3 μm depth are present in a fiber cross section outer circumferential part.

13. The acrylic based composite fiber according to claim 2, having a deodorizing ratio with respect to a carboxylic acid of 90% or more.

14. The acrylic based composite fiber according to claim 2, having a deodorizing ratio with respect to an acetic acid of 95% or more.

15. The acrylic based composite fiber according to claim 2, having a deodorizing ratio with respect to a nonanal of 90% or more.

16. The acrylic based composite fiber according to claim 2, having a moisture absorbing ratio Aa at a 40° C. temperature and 90% RH humidity environment of 15.0% or less, a moisture absorbing ratio Ab at a 20° C. temperature and 65% RH humidity environment of more than 2%, and a moisture absorbing ratio difference ΔA (=Aa−Ab) at the time of transfer from the 40° C. temperature and 90% RH humidity environment to the 20° C. temperature and 65% RH humidity environment of less than 1.5.

17. The acrylic based composite fiber according to claim 16, wherein the moisture absorbing ratio Aa at the 40° C. temperature and 90% RH humidity environment is from 3.0% to 8.0%, and the moisture absorbing ratio Ab at the 20° C. temperature and 65% RH humidity environment is more than 2% and less than 6.5%.

18. A fiber composite comprising the acrylic based composite fiber according to claim 2.

* * * * *